United States Patent [19]

Davidson

[11] Patent Number: 4,729,496

[45] Date of Patent: Mar. 8, 1988

[54] APPLICATOR CLAMP FOR A DISPENSING TUBE

[76] Inventor: Peter Davidson, 237 Merriweather, Grosse Pointe Farms, Mich. 48236

[21] Appl. No.: 907,854

[22] Filed: Sep. 15, 1986

[51] Int. Cl.[4] ..... B65D 37/00

[52] U.S. Cl. ..... 222/215; 24/546; 24/563; 222/99; 222/107

[58] Field of Search ..... 222/93, 95, 97–103, 222/206, 92, 107, 214, 215; 251/6, 9, 10; 132/84 D; 206/277; 24/563, 570, 571, 545, 546

[56] References Cited

U.S. PATENT DOCUMENTS

| | | | |
|---|---|---|---|
| 607,530 | 7/1898 | Taylor | 24/570 X |
| 1,826,189 | 10/1931 | Rothwell | 222/97 X |
| 1,859,174 | 5/1932 | Sassano | 222/102 |
| 1,885,291 | 11/1932 | Rickenbacher | 222/97 X |
| 2,013,389 | 9/1935 | Lovrich | 222/97 |
| 2,021,609 | 11/1935 | Pippert | 24/546 X |
| 2,615,595 | 10/1952 | Ivins | 222/102 |
| 3,088,632 | 5/1963 | Hickey | 222/100 |
| 3,759,421 | 9/1973 | Hausmann | 222/99 |
| 4,448,333 | 5/1984 | Ferrari | 222/103 X |
| 4,576,314 | 3/1986 | Elias et al. | 222/99 X |

FOREIGN PATENT DOCUMENTS

| | | | |
|---|---|---|---|
| 2539292 | 7/1984 | France | 222/102 |
| 171358 | 7/1922 | United Kingdom | 24/546 |

*Primary Examiner*—Joseph J. Rolla
*Assistant Examiner*—Kevin P. Shaver
*Attorney, Agent, or Firm*—Cullen, Sloman, Cantor, Grauer, Scott, & Rutherford

[57] ABSTRACT

An applicator clamp for a flexible dispensing tube having an outlet comprises a unit body including a pressure plate terminating in an open-ended retainer tube having a free edge spaced from and defining with the pressure plate a throated opening adapted to progressively receive flattened end portions of the dispensing tube with adjacent reverse-turned portions of the dispensing tube projected through one end of the retainer tube and anchored therein. Manual pressure applied to the plate into the dispensing tube extrudes the stored material through the outlet.

2 Claims, 8 Drawing Figures

FIG.1
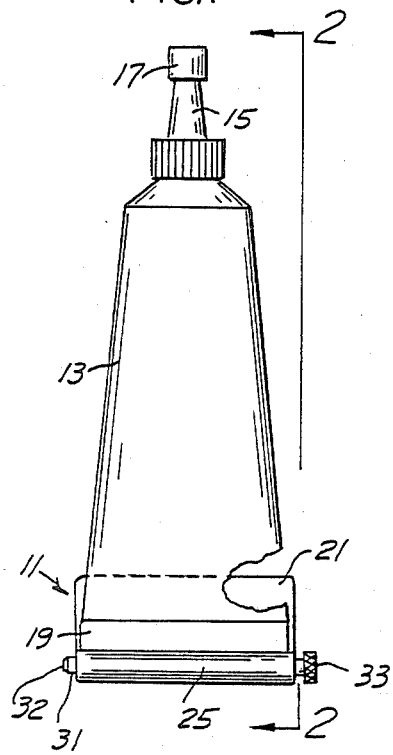
FIG.2
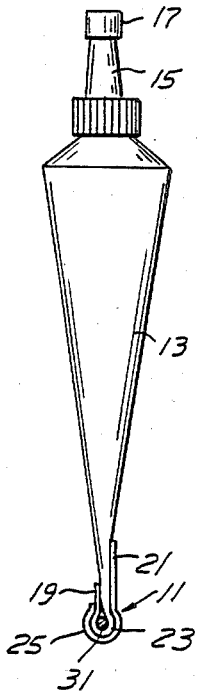
FIG.3
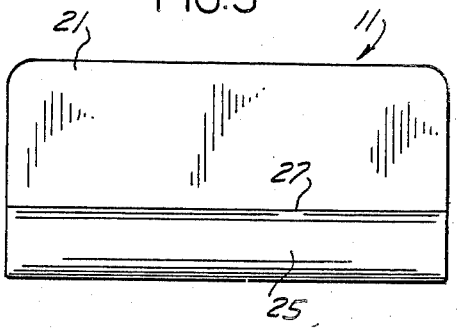
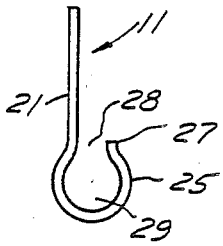
FIG.4
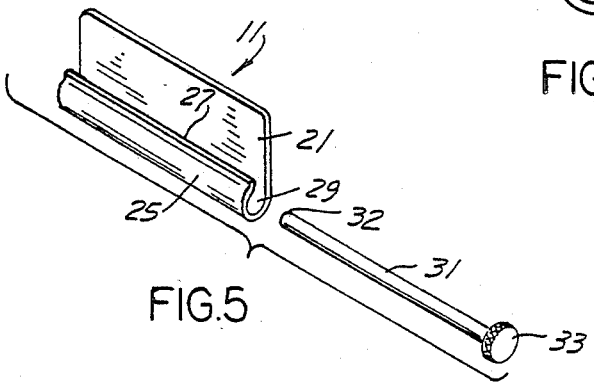
FIG.5
FIG.6
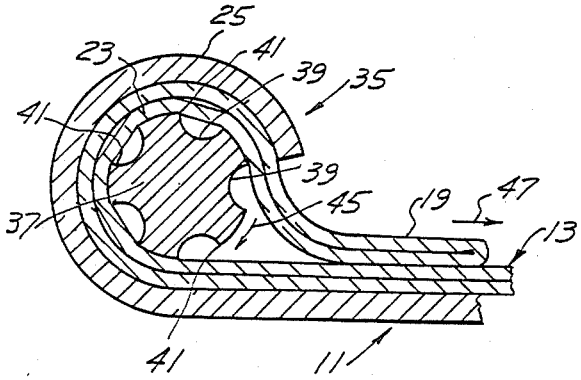
FIG.8
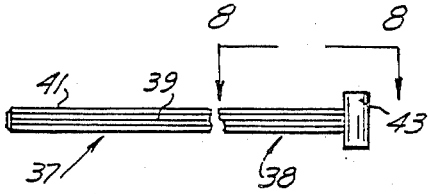
FIG.7

APPLICATOR CLAMP FOR A DISPENSING TUBE

FIELD OF INVENTION

The present invention relates to an applicator clamp connectible of the flattened end of a material-dispensing tube to facilitate extruding of stored material therefrom.

BACKGROUND OF THE INVENTION

Heretofore in dispensing tubes made of plastic material, as distinguished from metal foil, wherein various types of materials are stored for dispensing by manual application of pressure to the body of the tube, there have been difficulties in obtaining uniform manual application of pressure to the tube and for the uniform flow of stored material through the tube outlet.

Dispensing tubes are found particularly in areas which employ caulking materials, bonding agents, silicones, pipe sealants, and though not limited thereto, could include other viscous materials such as toothpaste, putty and the like.

In presently employed plastic tubes, which are resilient, flexible, and have a memory, these normally return to their initial shape upon removal of manual pressure therefrom with the result that it is difficult to uniformly extrude the material from the tube and difficult to use up all of the material within the tube thoughout its length. This is particularly true in the case of plastic or nonmetallized tubes, and wherein as can be recalled in the case of toothpaste, the metal tube was foldable as the material was extruded and stayed folded until all of the material was extruded therefrom.

SUMMARY OF THE INVENTION

The present invention is directed to an applicator clamp for a flexible dispensing tube such as would normally dispense products in industry such as caulking compounds, bonding agents, silicones, pipe thread sealants and the like. The present clamp could also be adapted for the dispensing from flexible plastic tubes of other materials, including toothpaste, putty and the like.

An important feature of the present invention is to provide an applicator clamp of a unit construction which may be made of aluminum, steel, or of a plastic material and which includes a pressure plate and, as an extension thereof along one longitudinal edge, a retainer tube adapted to receive and anchor, a reverse-turned or folded-over flattened portion of a dispensing tube from which some of the contents at one end have been dispensed.

An important feature of the present invention is to provide an applicator clamp comprising a unit body having an elongated, generally rectangular pressure plate and an open-ended retainer tube along one longitudinal edge thereof. The retainer tube terminates in a longitudinal edge spaced from the pressure plate defining therewith a throated opening along the length of the plate adapted to progressively receive flattened end portions of a dispenser tube and wherein adjacent flattened portions of the dispenser tube have been reverse-turned and projected through one end of the open-ended retainer tube and nested and retained therein.

A further feature is that with the flattened folded-over portion of the dispensing tube nested and retained within the retainer tube of the applicator clamp, manual pressure applied to the pressure plate provides a means of uniformly applying pressure to the remaining contents of the tube, starting from the lower end thereof adjacent to which the present applicator clamp is anchored and mounted. This provides on removal of the cap from the dispensor outlet, uniform manular pressure so that the contents are gradually extruded and advanced through the tube outlet until all of the liquid-type or viscous material has been dispensed.

As a further feature, as the contents of the tube have been dispensed, the tube is manually flattened progressively from the end thereof and the flattened end formed into a U-shape and manually projected into the open end of the retainer tube and transversely thereof throughout its width. The reverse-turned flattened end of the tube is effectively anchored within the applicator clamp. Subsequent application of manual pressure to the pressure plate provides uniform pressure to the tube and its contents in such manner as to uniformly dispense the contents from the tube until all of the contents have been used.

Another feature includes the use of a rigid headed locking pin which is projected through and along the lenth of the retainer tube and upon the interior of the reverse-turned flattened tube portion so as to positively anchor the flattened portion of the tube within the applicator clamp.

As a further feature with the reverse-folded flattened end portions of the dispensing tube more loosely disposed within the retainer tube and the anchoring pin therein being fluted or serrated along its length, or manual rotation of the anchor pin, portions of the tube are longitudinally advanced within the applicator clamp without removing the dispenser tube therefrom.

These, and other objects and features, will be seen from the following specification and claims in conjunction with the appended drawings.

THE DRAWINGS

FIG. 1 is a front elevational view of a dispensing tube having an outlet at one end and the present applicator clamp mounted over its other end.

FIG. 2 is a side elevational section thereof taken in the direction of arrows 2—2 of FIG. 1.

FIG. 3 is a front elevational view of the applicator clamp shown in FIG. 1 on an increased scale.

FIG. 4 is a left side elevational view thereof.

FIG. 5 is a bracketed and exploded view of the present applicator clamp and a locking pin as shown in FIG. 1.

FIG. 6 is a fragmentary elevational section on an increased scale of a modified applicator clamp and wherein the lock pin is fluted for rotative frictional engagement with the flattened tube for advancing the tube.

FIG. 7 is a side elevational view of the feed pin shown in FIG. 6 on a reduced scale.

FIG. 8 is a view taken in the direction of arrows 8—8 of FIG. 7.

It will be understood that the above drawings illustrate merely preferred embodiments of the invention, and that other embodiments are contemplated within the scope of the claims hereafter set forth.

DETAILED DESCRIPTION OF AN EMBODIMENT OF THE INVENTION

Referring to the drawing, FIGS. 1–5, the present applicator clamp 11 is adapted for use in conjunction with the dispensing tube 13 having a dispenser outlet 15 and a removable cap 17. Said tube normally contains a liquid or viscous material normally stored therein and wherein on application of manual pressure to the tube, conventionally constructed of a plastic, material such as caulking material, bonding agents, silicones or similar material including putty or even toothpaste, is progressively dispensed.

With present day commercial-type dispensing tubes 13 made of a plastic material, such as polyehtylene or polystyrene or the like, there is a built-in memory in the material such that even though partly dispensed, the tube often returns to its initial shape.

The present applicator clamp 11 includes a unit body having an elongated pressure plate 21 of a general rectangular shape which may be constructed of aluminum, steel or a plastic material. Alone one longitudinal edge of pressure plate 21 is formed the elongated open-ended retainer tube 25, FIG. 5, as an extension from said pressure plate.

Retainer tube 25 at one end terminates in the elongated transverse end flange 27 which is out-turned and normally spaced from pressure plate 21, FIGS. 2, 4, and 5. End flange 27 is substantially parallel to the pressure plate and defines with said pressure plate a throated opening 28 through which extends flattened end portion 19 of dispenser tube 13, FIG. 2.

Inwardly of end portion 19, in the flattened portion of tube 13, representing that portion of the tube from which material has been dispensed, there is a reverse-turned or folded-over end portion 23 adapted for longitudinal projection through one of the open ends 29 of the retainer tube 25 to the assembly position shown in FIGS. 1 and 2. The lower-most portion of tube 13 adjacent portion 23 also extends through opening 28.

As in FIG. 2, the major portion of pressure plate 21 bears against adjacent transverse portions of dispensing tube 13 throughout its width. These are the portions which contain thereunder material to be dispensed from said tube through outlet 15 when cap 17 is removed.

A rigid lock pin 31 having a length greater than the width of pressure plate 21 projects along the length of retainer tube 25 and within reverse-turned flattened portion 23 of tube 13, FIG. 2. Lock pin 31 at one end has an enlargement which is in the form of a head 33, FIG. 5, to facilitate removal of the pin as needed. Said pin is removed whenever it is necessary to advance flattened end portions progressively of tube 13 as additional material is extruded through outlet 15. The reverse-turned tube portion 23 inwardly of end portion 19 is again reprojected through one of the open ends 29 of retainer tube 25.

By constructing the lock pin 31 of greater length than the width of pressure plate 21, by applying the free end of pin 31 to a support surface with some manual pressure, the pin is partly removed, FIG. 1, to facilitate manual withdrawal. The other end of pin 31 is chamfered at 32 to facilitate assembly into anchor position, FIG. 2.

By the application of manual pressure to portions of pressure plate 21, uniform pressure is applied to tube 13 across its width, with the result that all of the material within tube 13 is gradually dispensed or extruded through outlet 15 and none of the material need be wasted. Thus, the present applicator tube facilitates the uniform manual extrusion of stored material from the tube through outlet 15 permitting uniform application of the material as the need may be, such as in a straight line of uniform width for caulking.

Progressively as the material is used up within the tube, the tube is separated from applicator clamp 11 and the flattened end is advanced with the result that the adjacent end portions are formed into U-shape at 23 and advanced longitudinally, after which the reverse-folded portion 23 of the tube is re-inserted into one open end 29 of the retainer tube 25 to the assembled position, FIG. 1, for further application of pressure through pressure plate 21 until progressively all of the material within the tube has been dispensed.

Heretofore, in constructions of this nature without the use of Applicant's applicator tube, ingenious mechanics have taped the folded-over end of the dispenser tube to keep it in folded-over form. The use of the present applicator tube obviates the use of such tape or other anchor for the folded-over portion of the tube which might open up absent some anchoring means.

The vertical height of the pressure plate 21 provides for increased leverage of manual pressure as applied to the tube and its contents for the uniform dispensing and extruding of material through outlet 15.

MODIFICATION

A modified applicator clamp is shown at 35, FIG. 6, wherein the primary change is that feed pin 37 has a shank serrated or fluted at 38, FIG. 7.

The serrated or fluted portion includes a series of spaced longitudinal grooves 39, FIGS. 6 and 7, with portions of the shank of the feed pin 37, namely leading edge portions 41, or corners, providing a means for frictionally engaging interior portions of the flattened tube. Upon rotation of feed pin 37 by its transverse handle 43, the flattened portion of the tube is advanced as shown by the arrow 47 on rotation of the applicator clamp 35 in the direction of the arrow 45, FIG. 5. This provides a means by which, as the material within the dispensing tube is used and the lower portion of the tube consequently flattens using the present applicator clamp, shown on an increased scale in FIG. 6, it is not necessary to remove the flattened end portion of the tube from the applicator clamp in order to advance the tube.

Instead, manual rotation of feed pin 37 and its fluted or serrated shank 39-41 provides a means of mechanically advancing flattened end portions 19 of the tube until all of the contents of the tube have been dispensed.

The present invention could also be adapted to dispensing tubes for glazing materials, haircare lotions, toothpaste or other materials which are partly viscous which can be conveniently stored in such tubes and easily dispensed in a uniform manner utilizing the present applicator clamp.

Having described by invention, reference should now be had to the following claims.

I claim:

1. In combination an applicator clamp and a flexible dispensing tube made of a material with a built-in memory to return to an initial shape after an end portion of the dispensing tube has been reverse-turned into a folded-over shape, the dispensing tube having an end opposite said end portion, said end having a disperser outlet, the clamp comprising:

an elongated pressure plate; and an open-ended retainer tube into which said elongated pressure plate curvingly extends to form a unit body therewith, said unit body curvingly extending to terminate a longitudinal edge spaced from said pressure plate and defining with said pressure plate a throated opening to progressively receive a flattened end portion of the dispensing tube after the respective end portion has been manually reverse-turned while separated from the clamp and projected through one end of said retainer tube and nested and retained between said pressure plate and said longitudinal edge, the flattened end portion projecting from the throated opening in a direction toward said dispenser outlet; whereby manual pressure applied to said pressure plate exerts a uniform pressure across the width of said dispensing tube and its underlying contents of stored material, for continuously extruding the stored material through the dispenser outlet while said retainer tube anchors the dispensing tube against returning to the initial shape, thereby preventing the stored material from backing into said dispenser tube.

2. The combination applicator clamp and dispensing tube of claim 1, wherein said retainer tube into which said pressure plate extends, includes an upturned elongated flange spaced from said pressure plate, said upturned elongated flange adapted to cooperate with said pressure plate to operatively grip the flattened end portion of said dispensing tube after the flattened end portion has been manually reverse-turned into a folded-over shape.

* * * * *